United States Patent [19]

Chittenden

[11] Patent Number: 4,836,548

[45] Date of Patent: Jun. 6, 1989

[54] ESCAPE MECHANISM FOR SLIDING BLOCK PUZZLES

[76] Inventor: Duane R. Chittenden, 305 El Mar Dr., Rochester, N.Y. 14616

[21] Appl. No.: 87,864

[22] Filed: Aug. 21, 1987

[51] Int. Cl.[4] ..... A63F 9/08
[52] U.S. Cl. ..... 273/153 S
[58] Field of Search ..... 273/153 S

[56] References Cited

U.S. PATENT DOCUMENTS 4,422,641 12/1983 Collin ..... 273/153 S
4,441,715 4/1984 Titus ..... 273/153 S

*Primary Examiner*—Anton O. Oechsle

[57] ABSTRACT

A mechanism for easy removal of the sliding blocks from a sliding block puzzle of tongue and groove design, allowing the user to remove and rearrange the blocks to start over.

2 Claims, 2 Drawing Sheets

ESCAPE MECHANISM FOR SLIDING BLOCK PUZZLES

BACKGROUND OF THE INVENTION

1. Field of the Invention

The invention relates generally to an improved design of sliding block puzzles.

2. Description of Prior Art

Sliding block puzzles may be loose blocks that slide around in a tray. Any one or more blocks may be lifted out of the tray or may be dumped out of the tray by turning it upside down. The problem with loose blocks is that they can spill out unintentionally and get lost.

Another design of sliding block puzzles may be of tongue and groove construction on the sides of each block and on the frame of the tray so that once assembled, the blocks can slide against each other and against the frame. The tongue and groove have them locked into each other and the frame so that any one or more blocks cannot be lifted out of the tray, nor can they be dumped out of the tray by turning it upside down, nor can they be removed in any way short of disassembly of the manufacture. While this self-containment solves the problems of spillage and loss, the problem is that the user cannot remove and rearrange blocks for a fresh start.

SUMMARY OF THE INVENTION

This invention relates to a mechanism that allows for one or more blocks to be intentionally removed from the tray and/or inserted into the tray of a sliding block puzzle, while maintaining the integrity of self-containment.

The objective of this invention is to:

1. Allow the user to remove the blocks from a solved or partially solved puzzle and reassemble the blocks into start positions, thus adding enjoyment for the user.

2. Allow ease of initial assembly in manufacture, thus simplifying the assembly process and perhaps lowering manufacturing costs.

DESCRIPTION OF THE PREFERRED EMBODIMENT

Figure 1:
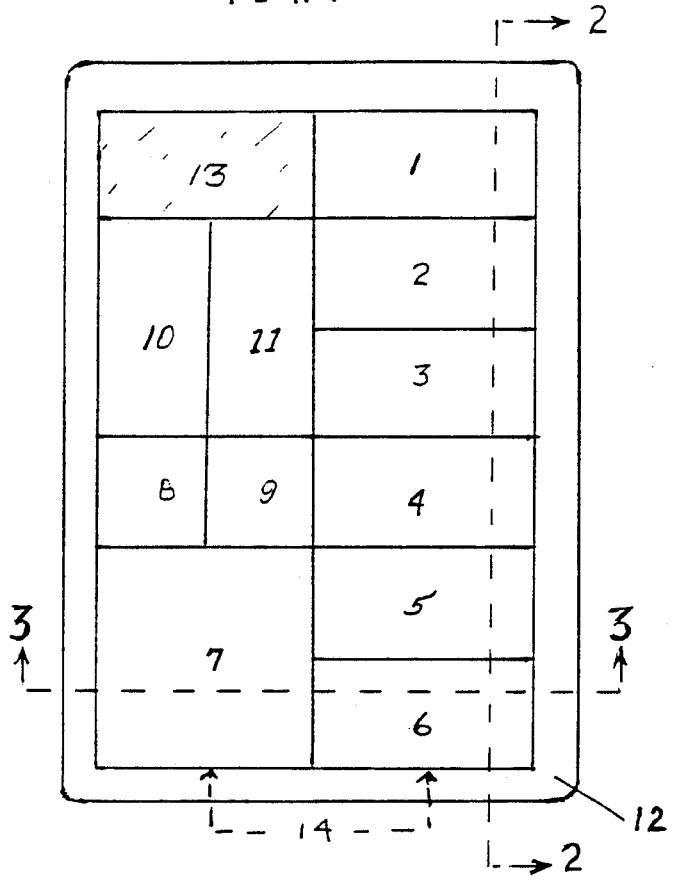
FIG. 1 is a view of the working surface of a sliding block puzzle of prior art.
Figure 2:
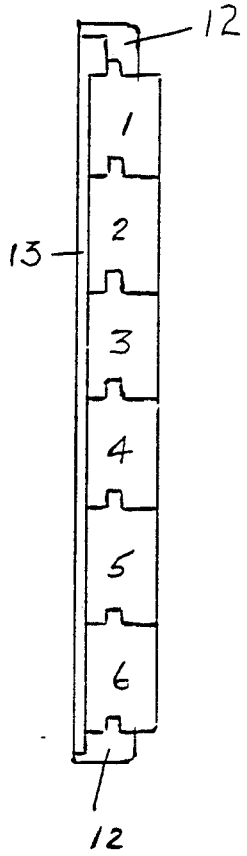
FIG. 2 is a sectional view along Section 2—2 of FIG. 1.
Figure 3:
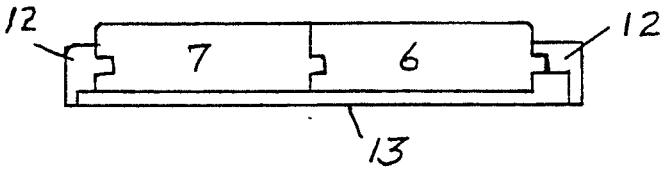
FIG. 3 is a sectional view, along Section 3—3 of FIG. 1.

FIGS. 1, 2 and 3 show an embodiment of a typical sliding block puzzle as a reference point of prior art, consisting of sliding blocks 1–11 and a tray consisting of a frame 12 and a bottom 13.

An ideal location for the Escape is at location 14 where the block 6 to be removed can be positioned, but would not normally rest in use or in storage, although the Escape could be located in other positions. Block 6 can be moved into position 14 by sliding the blocks 7, 8, 9, 10 and 11 forward, making way for block 6 to be moved to the left.

Figure 4:
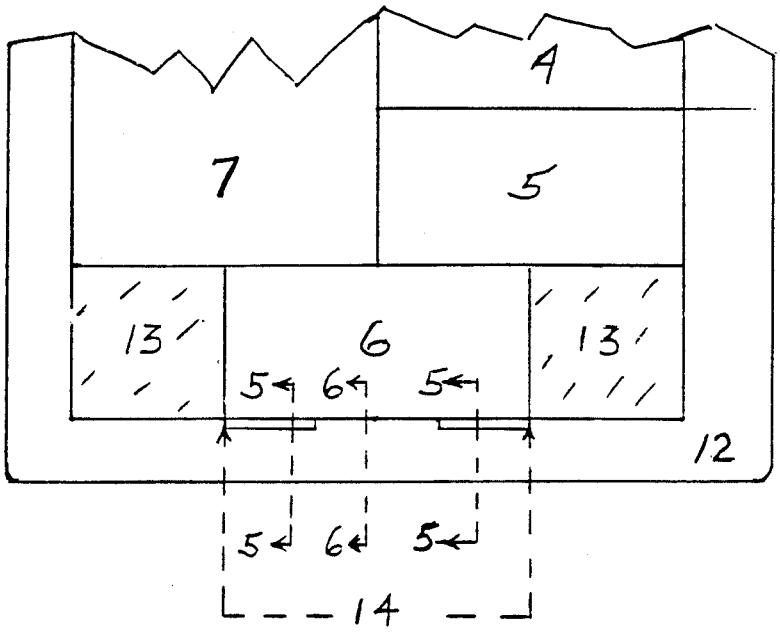
FIG. 4 is a view of the area of the Escape mechanism.
Figure 5:
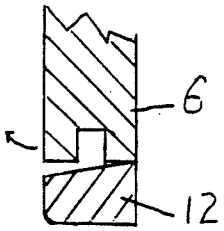
FIG. 5 is a sectional view, along Section 5—5 of FIG. 4.
Figure 6:
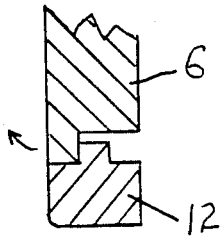
FIG. 6 is a sectional view, along Section 6—6 of FIG. 4.
Figure 7:
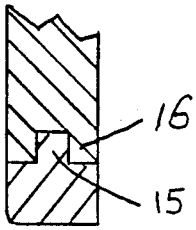
FIG. 7 is a sectional view of a typical tongue and groove, furnished for reference.

FIGS. 4, 5 and 6 constitute the embodiment of the invention, and FIG. 7 is a reference point of prior art. Referring to FIG. 5, the invention is to eliminate the tongue 15 (shown in FIG. 7) of the frame 12 for some distance along the parallel of the Escape Location 14 and to eliminate enough additional material to allow for radial clearance when lifting the adjacent edge of block 6 and tilting it out of the frame 12.

Continuing with the invention and referring to FIG. 6, eliminate the bottom groove flange 16 (shown in FIG. 7) of block 6 for the remainder of the distance along the parallel of the Escape Location 14 and eliminate enough additional material to allow for radial clearance when lifting the edge of block 6 and tilting it out of the frame 12.

The amount of additional material to eliminate to provide radial clearance will vary depending on the thickness of parts and the closeness of fit.

Thus, block 6 must be positioned in the Escape Location to be removed and no other block, even when in that location, can be removed. However, referring to FIG. 1, blocks 1, 2, 3, 4, and 5, if manufactured like block 6, would also be removable through the same Escape Location.

These modifications to design would be done in parts manufacturing.

I claim:

1. In a sliding block puzzle comprising a game which includes a plurality of frame members and a plurality of blocks slidable within the frame, the blocks mating with each other and the frame by means of tongues and grooves disposed in complementary relationship on adjoining ones of said blocks and by grooves in the inwardly facing walls of selected ones of said frame members and by tongues on the inwardly facing walls of the remaining ones of said frame members, said tongues and grooves cooperating to retain the blocks within the frame, wherein the improvement comprises the modification of the tongue along a section of one of said remaining frame members and the modification of the groove of one of the blocks, the modifications being such that when said one block is positioned adjacent said frame member section the block can be removed from the frame.

2. In a sliding block puzzle as defined in claim 1, wherein said modifications comprise the elimination of the bottom flange along a portion of said groove of said one block and the elimination of the tongue on said frame member section, said eliminated bottom flange and tongue being so related to each other that when said one block is positioned so that said portion of said block along which the bottom flange is eliminated is in juxtaposition to a portion of said one frame member in which the tongue has not been eliminated and a portion of said one block in which the lower flange has not been eliminated is in juxtaposition to the section of said frame member along which the tongue is eliminated said one block can be removed from said frame.

* * * * *